US005667262A

United States Patent [19]

Planchon

[11] Patent Number: 5,667,262

[45] Date of Patent: Sep. 16, 1997

[54] PORTABLE, ADJUSTABLE DOOR LOCK DEVICE AND METHOD OF USE

[76] Inventor: Paul O. Planchon, 2580 Melody La., Reno, Nev. 89512

[21] Appl. No.: 676,563

[22] Filed: Jul. 8, 1996

[51] Int. Cl.[6] ..... E05C 19/18

[52] U.S. Cl. ..... 292/288; 292/289; 292/291

[58] Field of Search ..... 292/288, 289, 292/291, 293, 305, 258

[56] References Cited

U.S. PATENT DOCUMENTS

| | | | |
|---|---|---|---|
| 1,387,765 | 8/1921 | Colonna . | |
| 1,672,166 | 6/1928 | Lochhead | 292/293 |
| 3,161,428 | 12/1964 | Zook | 292/292 |
| 3,671,067 | 6/1972 | Wegner et al. | 292/292 |
| 3,854,764 | 12/1974 | Corrigan | 292/289 |
| 4,082,335 | 4/1978 | Smith | 292/291 |
| 4,429,913 | 2/1984 | Bey | 292/293 |
| 4,462,624 | 7/1984 | Zanzonico | 292/291 X |
| 4,471,981 | 9/1984 | Wright | 292/292 |
| 5,000,498 | 3/1991 | Upchurch | 292/258 X |
| 5,135,272 | 8/1992 | Centofante | 292/293 |
| 5,265,922 | 11/1993 | Falcone | 292/258 |
| 5,297,829 | 3/1994 | Richardson | 292/289 |
| 5,325,685 | 7/1994 | Frank | 70/14 |
| 5,360,245 | 11/1994 | David et al. | 292/289 |
| 5,462,322 | 10/1995 | Berezansky | 292/288 |

*Primary Examiner*—Rodney M. Lindsey
*Assistant Examiner*—Monica E. Millner

[57] ABSTRACT

A portable, adjustable door lock device and method of use therefore, which provides a device having a first and second blade member which are pivotably pinned together, thus, forming substantially a "V-shaped member" having two pointed ends, with the ends being insertable and adjustably positionable between the edge of a door and the striker plate affixed to a door frame, so as to frictionally capture the reciprocable bolt therein, thus, preventing opening of the door from the exterior side.

5 Claims, 1 Drawing Sheet

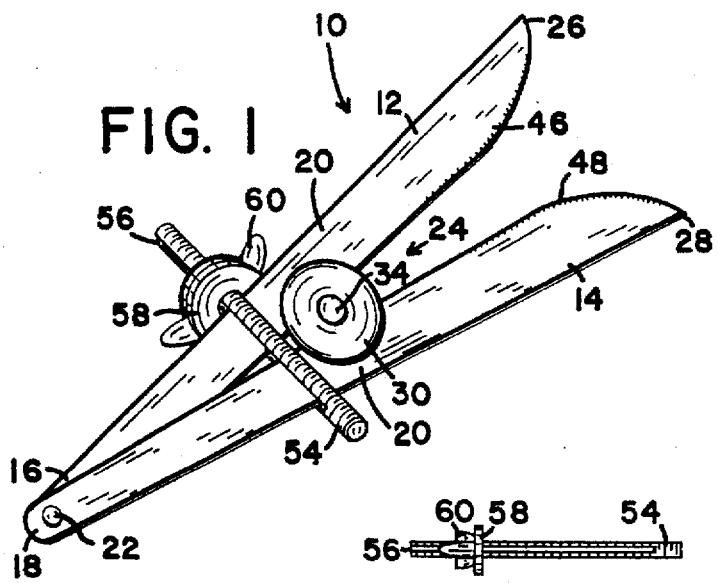
FIG. 1
FIG. 2
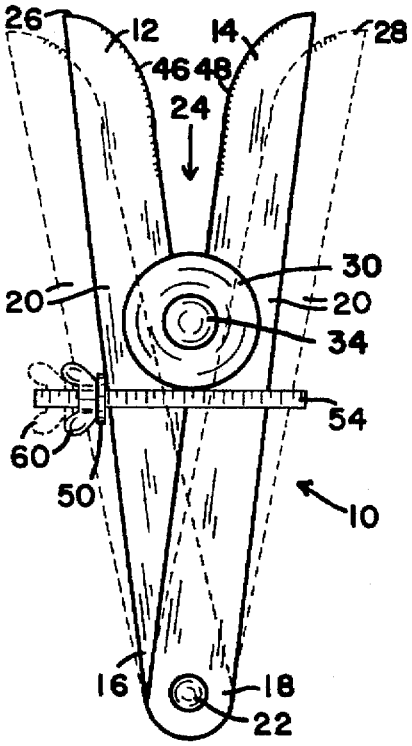
FIG. 3
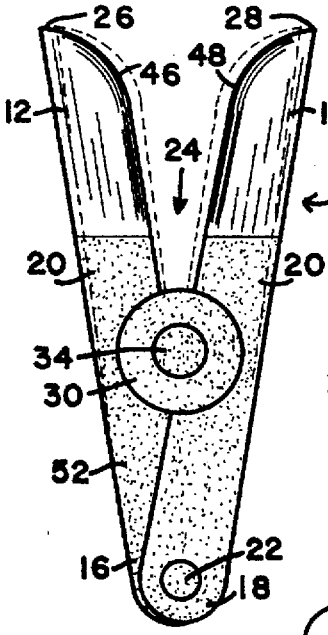
FIG. 5
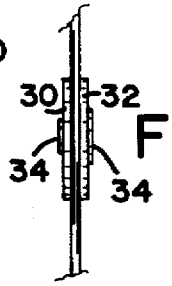
FIG. 4
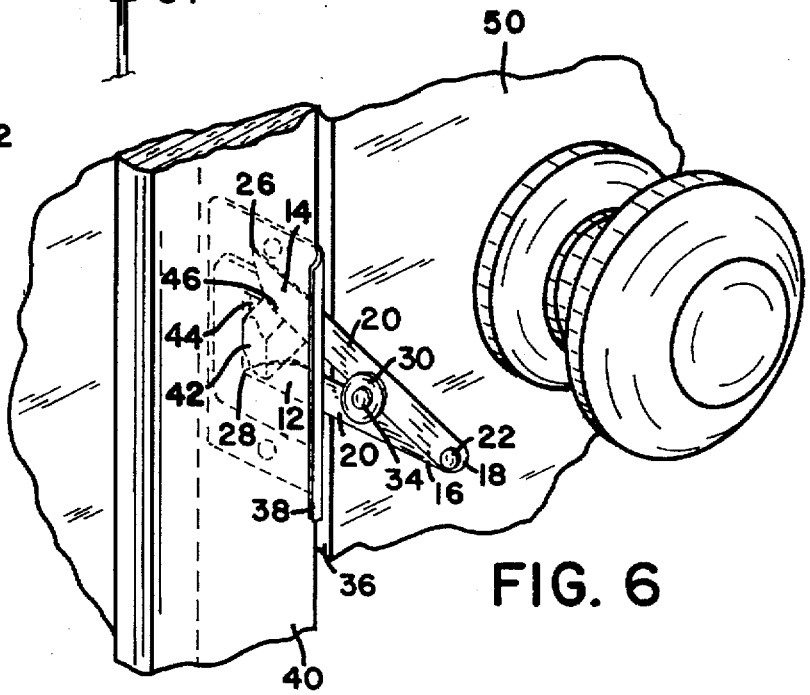
FIG. 6

PORTABLE, ADJUSTABLE DOOR LOCK DEVICE AND METHOD OF USE

FIELD OF THE INVENTION

This invention relates to accessory door locks but more particularly relates to a door lock which includes a first and a second blade member which are pivotably connected at one end thereof with their opposite ends being adjustably, removably insertable in between the edge of the door and the striker plate affixed to the door frame, so as to frictionally capture the bolt therein, thus, preventing opening of the door from the exterior side.

BACKGROUND OF THE INVENTION

It is contended by the applicant that there is a great need for an improved accessory door lock apparatus which is portable so as to be easily carried by a person while traveling and which further provides the user with increased security and privacy while staying in their room behind a locked door at a motel, hotel, or the like. Although such establishments often provide interior security devices, such as dead bolts, chains, etc., which may be secured from within the room by a patron, it is also well known that some persons, such as hotel employees, have master keys which are capable of overriding the interior security devices. It is also true that criminals and other unscrupulous persons can obtain or create such override devices. Consequently, the traveller can never completely rely on the security devices provided by the hotel, motel, or the like.

In the past, numerous devices have been proposed heretofore for ensuring the ability of a person to securely lock the doors of hotels, motels, etc. However, many of the prior art devices have been much to expensive to manufacture and purchase and most have been much to complex to install and remove. Also, other prior art devices require the device to be permanently installed and, hence, have not been capable of being removed by a traveler and transported from one room to the next.

The following references are exemplary of such prior art devices. U.S. Pat. Nos. 5,360,245, 5,325,685, 4,471,981 and 3,671,067, each of which provide a portable door lock device, however, in each reference the user must partially install the device while the door is open and then secure the installation after the door is closed and this can be very time consuming and most frustrating when one is tired and when one only wishes to close the door.

Still other prior art devices have been taught, such as U.S. Pat. Nos. 5,297,829, 3,854,764 and 3,161,428, all of which may be installed after the door has been closed, however, each include many parts, are costly to manufacture and purchase, are complicated to use and none of the prior art references are adjustable so as to be attachable to various sized doors having various sized locks, such as taught by the present invention.

SUMMARY OF THE INVENTION

It is therefore contended by the applicant that there is a need for a portable, adjustable, accessory door lock device which overcomes the many inherent drawbacks and disadvantages of the known prior art.

It is therefore an object of the present invention to provide a portable, adjustable door lock which can be easily carried in the users pocket or purse, and which is removably, adjustably, attachable to various sized doors having various sized door locks.

Still another object of the present invention is to provide an accessory door lock which is removably, adjustably, attached to a door of choice after the door has been closed and locked.

Also, a further object of the present invention is to provide a portable door lock device which includes very few parts.

Yet another object of the present invention is to provide a first and a second embodiment for an accessory door lock.

Still a further object of the present invention is to provide a portable door lock which can be made from substantially any suitable material of choice, such as hard plastic, aluminum, metal, etc.

Also, another object of the present invention is to provide a portable door lock which includes unique adjustment means, which heretofore has not been seen nor taught within the prior art.

Still further, another object of the present invention is to provide a portable door lock which is economical to manufacture and which is easily marketable.

Yet another object of the present invention is to provide a portable door lock which recognizes the inherent disadvantages of the known prior art and which addresses and overcomes such disadvantages in a manner heretofore not seen nor taught.

Other objects and advantages will be seen when taken into consideration with the following drawings and specification.

BRIEF DESCRIPTION OF THE DRAWINGS

FIG. 1 is substantially a perspective side view of the preferred embodiment for the present invention.

FIG. 2 is substantially a side view of a bolt, a wing nut and a washer.

FIG. 3 is substantially a frontal view of the preferred embodiment and shows a first position with a second position shown in ghost lines.

FIG. 4 is substantially a partial side view of FIG. 5.

FIG. 5 is substantially a frontal view of a second embodiment for the present invention.

FIG. 6 is substantially a plan view for the present invention.

DETAILED DESCRIPTION OF THE DRAWINGS

Referring now in detail to the drawings wherein like characters refer to like elements throughout the various views, arrow (10) of FIG. 1 is substantially an overview of the present invention which is a portable, adjustable door lock device which is formed from substantially a first and a second blade member (12) & (14), with each blade member being in the shape of a pocket knife blade, respectively, and each blade member having a first end (16), a second end (18) and substantially a central portion (20). It is to be noted that each of the blade members (12) & (14) may be made from substantially any suitable material of engineering choice, such as metal, aluminum, steel, semi-resilient plastic, etc.

Illustrated throughout the views, the first end (16) of the first member (12) and the first end (18) of the second member (14) are pivotably pinned together by substantially any suitable fastener of engineering choice, such as by pin (22), or the like, and when the first ends (16) & (18) of each member, are pinned in this manner, a V-shaped member (represented by arrow 24) is thus formed having two pointed legs (26) & (28), respectively.

Referring now to FIG. 4, wherein we show the central portion (20) of each blade member (12) & (14) being slidably positioned between a first and a second washer, (30) & (32), respectively, with the washers (30) & (32) being pivotably pinned together by a suitable fastener means of engineering choice, such as by pin (34).

Referring now to the plan view of FIG. 6, wherein each of legs (26) & (28), respectively, are shown as being positioned and inserted between the edge of a door (36) and the striker plate (38) which is affixed to the door frame (40), respectively, with the door (36) having therein a reciprocable bolt (42) which is movable into and out of a hole (44) through the striker plate (38) into the door frame (40), respectively. Also, legs (26) & (28) have opposed inside cutting edges (46) & (48), respectively, whereby, when the lock device is positioned between the edge of the door (36) and the striker plate (38), the edges (46) & (48) of legs (26) & (28), frictionally capture bolt (42) there between, thus, bolt (42) is held in a secure manner and the door (50) cannot be opened.

Referring now to FIG. 5, wherein we show the device (arrow 10), being partially coated with a flexible rubber covering (52) which allows device arrow 10) to be adjustable between a first and second position, with the first position being shown in solid lines and the second position being shown in ghost lines, respectively, this allows the device to be adjustable and removably attachable to various sized doors having various sized reciprocating bolts, such as bolt (42).

Referring now to FIGS. 1 & 3 which illustrates the preferred embodiment for the present invention, wherein lock device, (arrow 10), is not coated with a rubber covering but includes a threaded bolt (54) having an elongated slot (56) therein, with the slot being of a shape and size to capture the first and the second blade member (12) & (14) therethrough, with the bolt (54) being adjustably held in a secure manner by a washer (58) and a wing-nut (60). This allows the device (arrow 10) to be positionable between a first and a second position, with the first position being shown in solid lines, and the second position being shown in ghost lines in FIG. 3, so as to allow the device to be adjustable and removably attached to various sized doors having various sized reciprocating bolts, such as bolt (42).

It is to be further noted that the cutting edges (46) & (48) may be either shaped to be sharp, (as illustrated in FIG. 4), or if preferred, the cutting edges (46) & (48) may be serrated, (as illustrated in FIGS. 1 & 3). This allows the cutting edges (46) & (48) to cut and/or bite into the exterior surface of reciprocating bolt (42) and hold bolt (42) in an affixed yet removable manner.

It is to be further noted that we also herein provide a method of use for the present invention, (see embodiment of FIGS. 5 & 6), wherein we teach a method for attaching a portable, adjustable door lock device (arrow 10) to a closed door (50), with the door (50) having a door edge (36), a striker plate (38) attached to the door frame (40), and a reciprocable bolt (42) which is movable into and out of a hole (44) through striker plate (38) into the door frame (40), and the device (arrow 10) having two pointed legs (26) & (28), which have opposed inside cutting edges (46) & (48) for engagement with bolt (42), and the method of use including the following steps;

a. grasping lock device, (arrow 10); and b. inserting legs (26) & (28) slidably into and in between the edge of the door (36) and the striker plate (38), until each of the legs (26) & (28) firmly engage bolt (42) in a secure manner; whereby, door (50) cannot be opened until the device (arrow 10) has been removed.

We also include a method of use for the embodiment depicted in FIGS. 1 & 3, for removably attaching a portable, adjustable door lock device (arrow 10), to a closed door (50), with the door having a door edge (36), a striker plate (38) attached to a door frame (40), and a reciprocable bolt (42) which is movable into and out of a hole (44) through the striker plate (38) into door frame (40), and device (arrow 10), having a first and a second blade member each having a pointed leg which provide opposed inside cutting edges (46) a (48) for engagement with bolt (42), and a threaded bolt (54) having an elongated slot (56) therein, slot (56) being of a shape and size to capture the first and the second blade member therethrough, and threaded bolt (54) is adjustably held in a secure manner by a washer (58) and wing nut (60), thus, device (arrow 10) is adjustable between a first loosened position and a second tightened position, and the method comprising of the following steps;

a. grasping lock device (arrow 10);

b. adjusting threaded bolt (54) into its first position;

c. inserting the first and the second leg, (26) & (28) slidably into and in between the edge (36) of door (50) and striker plate (38) until cutting edges (46) & 48) each contact the outside edge of reciprocable bolt (42); and d. adjusting threaded bolt (54) into its second position, thus, cutting edges (46) & (48) each bite into the outside edge of reciprocable bolt (42), whereby;

reciprocable bolt (42) is held in a secure manner and door (50) cannot be opened until device (arrow 10) has been removed.

It will now be seen that I have herein provided a portable, adjustable door lock device which is removably attachable to substantially any suitable door of choice.

It will also be seen that I have herein provided a portable, adjustable door lock device which is easily carried by the user in their pocket and/or purse.

It will further be seen that I have herein provided a portable, adjustable door lock device which includes very few parts.

It will also be seen that I have herein provided a portable door lock device which is adjustable between a first and a second position.

It will still further be seen that I have herein provided a portable door lock device which is economical to manufacture and is easily marketable.

It will also be seen that I have herein provided a portable door lock device which may be produced in a variety of colors and from a variety of materials of engineering choice.

It will further be seen that I have herein provided a portable door lock device which addresses and overcomes all of the inherent drawbacks and disadvantages known to the prior art.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatuses.

Having described my invention, what I claim as new and wish to secure by a LETTERS PATENT is:

1. A portable, adjustable door lock device comprising: a first and a second blade member each having a first end a second end and a central portion, said first end of said first member and said first end of said second member being pivotably pinned together, thus forming substantially a V-shaped member having substantially two pointed legs, said central portion of each blade member being slidably detachably positioned between a first and a second washer, said first and said second washer being pivotably pinned together, said legs each being insertable between the edge of a door and a striker plate affixed to a door frame, said door having therein a reciprocable bolt movable into and out of a hole through said striker plate into said door frame, and said legs having opposed inside cutting edges for engagement with said bolt, whereby;

said edges of said legs may frictionally capture said bolt there between, thus, said bolt is held in a secure manner and said door cannot be opened.

2. The device of claim 1 wherein said device is partially coated with a flexible rubber coating and said rubber coating allows said device to be movably adjustable between a first and a second position.

3. The device of claim 1 wherein said device further includes a threaded bolt having an elongated slot which is of a shape and size to simultaneously capture said first and said second blade member there through, and said bolt is adjustably held in a secure manner by a washer and a nut, whereby;

said device is adjustable between a first and a second position.

4. The device of claim 1 further including said edges being sharp.

5. The device of claim 1 further including said edges being serrated.

* * * * *